United States Patent [19]

Stokes

[11] 4,229,004

[45] Oct. 21, 1980

[54] FLOOR TYPE POOL GAME APPARATUS

[76] Inventor: Alvin R. Stokes, 700 N. Zimmer, Pampa, Tex. 79065

[21] Appl. No.: 930,902

[22] Filed: Aug. 4, 1978

[51] Int. Cl.[3] ..... A63J 3/00

[52] U.S. Cl. ..... 273/3 C; 272/3; 273/DIG. 7; 273/6

[58] Field of Search ..... 272/2, 3 R, 3 A, 3 B, 272/3 C; 52/474, 662, 570, 571, 588; 428/57, 58, 59, 181, 156, 179, 44, 184, 185, 186; 273/2, 3

[56] References Cited

U.S. PATENT DOCUMENTS

| | | | |
|---|---|---|---|
| 2,615,308 | 10/1952 | Thorns | 272/3 |
| 3,042,562 | 7/1962 | Patterson | 428/179 |
| 3,779,547 | 12/1973 | Pappas | 272/3 |
| 3,898,855 | 8/1975 | Curfhey | 272/3 |
| 3,904,193 | 9/1975 | Patterson | 272/3 |
| 3,950,585 | 4/1976 | Hale | 428/179 |
| 3,951,406 | 4/1976 | Rock | 272/3 |
| 3,975,882 | 8/1976 | Waller | 428/184 |

*Primary Examiner*—Richard C. Pinkham
*Assistant Examiner*—T. Brown
*Attorney, Agent, or Firm*—Ely Silverman

[57] ABSTRACT

In a floor type billiard game, a playing surface strong enough to support the weight of adult players thereon while still dimensionally stable for accurate play thereon provides an overall apparatus light enough to be movable for varied location after installation, for transport and for adjustment for levelling of the playing surface. The playing surface is supported by a plurality of floor support units, each unit being trapezoidal in cross-section and each comprised of a core composed of a plurality of vertical rigid columns and being completely enclosed by a strong skin. The playing surface further has a lower foam rubber layer, a middle fabric layer and an upper pile layer. The billiard apparatus is provided with a cushioned rail, corner and side pockets as provided in a standard billiard table.

2 Claims, 7 Drawing Figures

FLOOR TYPE POOL GAME APPARATUS

BACKGROUND OF THIS INVENTION

The field of invention to which this invention pertains is game apparatuses of the nature of pool tables and crocquet games.

SUMMARY OF THE INVENTION

A frame and rigid cores are held within a tightly fitted skin to provide a composite waterproof structure of great rigidity and strength and yet light enough to be readily handled for movement, transport and adjustment.

DESCRIPTIONS OF THE FIGURES

DESCRIPTION OF THE PREFERRED EMBODIMENT

Figure 1:
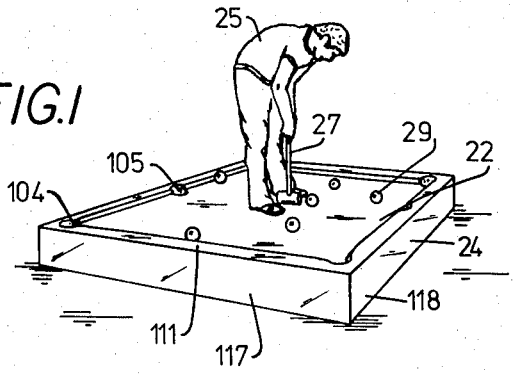
FIG. 1 is a perspective view of an operator utilizing the apparatus of this invention.

The overall apparatus 20 comprises a surface and surface support assembly and a rim and rim support assembly 24. This is a floor type billiard game.

In operation, a player as 25 on surface 75 of assembly 22 operates a mallet as 27 to drive balls as 29 into pockets as 101–106.

The surface and surface support assembly 22 comprises a frame assembly 30 and a plurality of like floor unit sub-assemblies as 40, 140 and 240, and, also, a plurality of like frame support and adjustment assemblies 121–124 and an upper surface layer.

Figure 4:
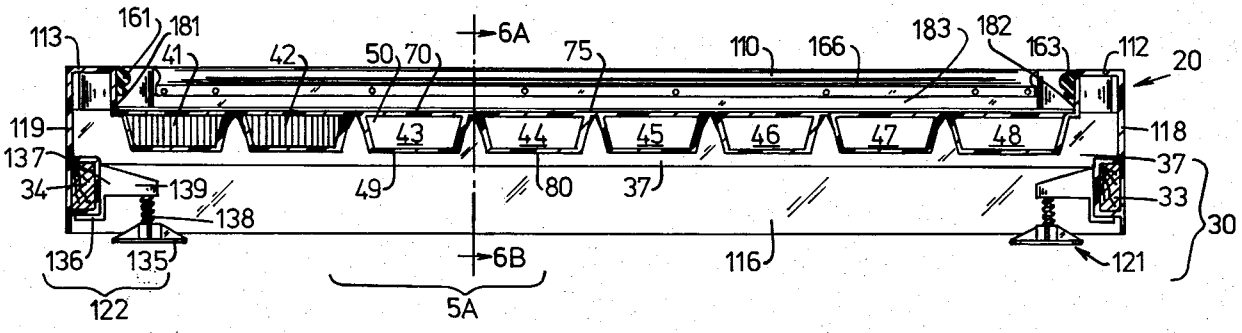
FIG. 4 is a vertical transverse section through the vertical plane 4A–4B of FIG. 3.

The frame 30 has a front base frame element 31, a rear base frame element 32, a left side base frame element 33 and a right side base frame element 34. These are all straight edged and rigid elements firmly joined together as a rectangle and serve to support thereabove and fixed thereto to rigid straight transverse upper frame elements as 35, 36, 37 and 38. Elements 35–38 are rigid straight parallel elements each of which, as 37, is firmly attached to base side elements as 33 and 34 as shown in FIG. 4.

The central floor unit sub-assembly 40 is formed of like floor support unit as 41–48, each identical to each other and also to the units 141–148 in the front floor unit assembly 140 and units 241–248 in the rear floor unit assembly 240; accordingly, the description of one such unit 43 applies to all the others.

The floor support unit 43 comprises a core 49 composed of a plurality of vertical rigid floor support columns as 50 and 60 and a strong skin 70. Each vertical floor support column as 50 comprises a plurality of vertical rigid walls 51–56 arranged in a hexagon form and enclosing a cavity 57. Each of these walls is formed of multilayered paper about 0.015 inches thick total and the cavity 57 therein is one-half inch in minimum diameter.

Figure 5:
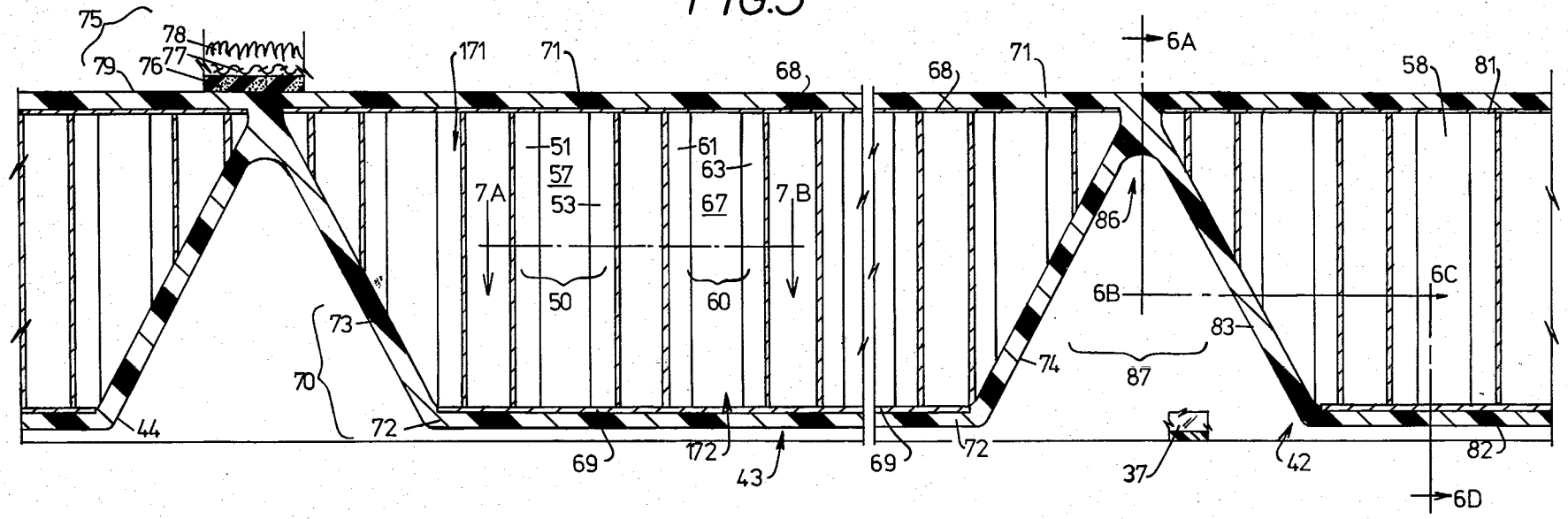
FIG. 5 is an enlarged diagrammatic view in zone 5A of FIG. 4 through section 5B–5C of FIG. 7 and shows the principal components of a floor support unit 43.

The cross-section of each floor support unit as 43 is trapezoidal in vertical longitudinal section as shown in FIG. 5. Each unit as 43 has a top flat portion 171, a bottom horizontal portion 172, a left sloped side portion 173 and a right sloped side portion 174.

In manufacture a skin 70 is formed as a thick (3/16 inch thick mold of fiberglass resin) polyester resin through which a mat of fiberglass roving or mat is evenly distributed at the rate of 1½ ounces of glass fiber per square foot of surface to which attached.

Such skin completely encloses and firmly and tightly embraces and is firmly attached to (a) the core portions, as 49 of the floor support units and (b) components of the frame assembly 30 and cooperates synergistically with such cores and frame to provide a light yet rigid support structure with a flat top for the surface 75.

Figure 3:
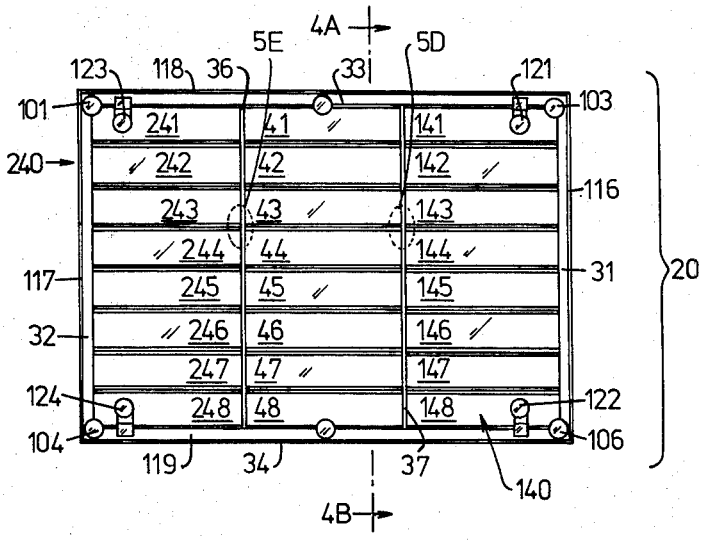
FIG. 3 is a bottom view of the apparatus 20.

The skin 70 accordingly provides a top portion 71, a flat bottom portion 72, a left oblique wall or skin portion 73 and a right oblique wall or skin portion 74 throughout its entire length (left to right) as shown in FIG. 3 and has a high tensile strength.

Figure 6:
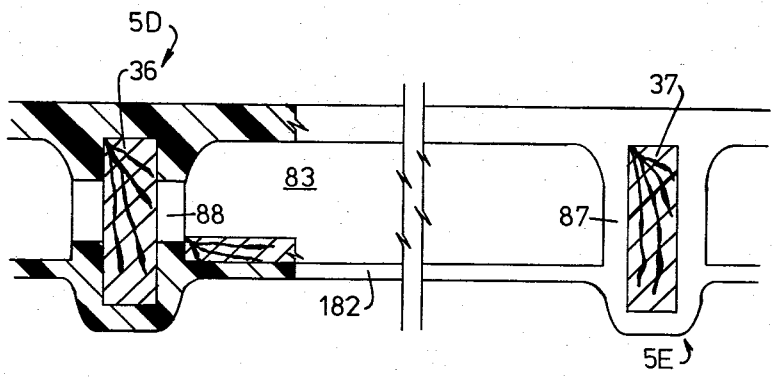
FIG. 6 is a vertical longitudinal sectional view through the broken section 6A–6B–6C–6D of FIG. 5.
Figure 7:
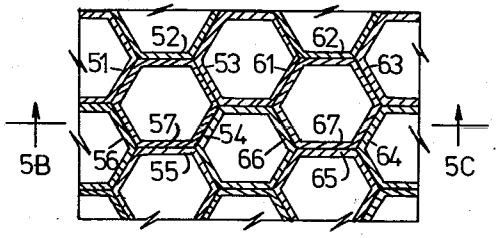
FIG. 7 is an enlarged transverse horizontal section through zone 7A–7B of FIG. 6.

Adjacent like unit 42 has a top skin layer 81, a bottom skin layer 82, and a left oblique skin or wall portion 83 corresponding respectively to like portions 71, 72 and 73 of unit 43, and unit 44 has the same structure. The top surfaces of adjacent units, as of the top surfaces layers 71 and 81, are firmly joined together at the junction of walls 83 and 74. Such firm joining together is shown in FIG. 5 at vertex zone 86. Additionally, the fiberglass skin which joins walls 83 and 74 at vertex zone 86 also forms a firm junction between skin layers as 81 and 71 is, further, strengthened as in zone 5D (see FIG. 6) by a gusset plate portion 87 which joins the skin or walls 83 and 74 and is attached firmly to the transverse member 37. A like gusset plate is also formed at zone 5E as shown in FIG. 3 adjacent to and attached to the walls as 74 and 83 and to the frame member 36.

The playing surface 75 is a carpet. It comprises a lower layer of foam rubber, an intermediate layer of tough fabric 77 and an upper pile layer 88. The foam rubber is firmly joined by glue as 79 to the top of the skin layers as 71 and 81, the fabric layer 77 is firmly joined to the foam rubber layer and the pile is firmly joined to the fabric layer in conventional fashion for outdoor carpet.

Each frame support and adjustment bracket as 122 comprises a rigid foot plate 135, a bracket 136, and a centrally directed arm 137. The bracket 136 is an L-shaped bracket, the bottom and sides of which are firmly attached to an adjacent frame member as 34; bracket 136 is also firmly attached to a horizontal centrally directed center arm as 137. Each horizontal center arm as 137 adjustably holds a threaded bar or screw 138 in a portion thereof as 139, or nut attached thereto, which is threaded and firmly held to the horizontal arm 137, so that each foot plate as 135 may be raised and lowered relative to the frame 30. Accordingly, each foot plate as 135 is vertically adjustable to provide for a level orientation of the top surface of the carpet 75.

The co-action of rigid core and tensile skin as above described and shown in FIG. 5 for each of the series of units as 41–48 provides at each such unit a truss action which there provides for a rigid support of the top surface 75 in a horizontal direction transverse to the length of the frame 30. Additionally, the tensile support of the skin 70 about each core portion in view of its attachment to and support by the transverse frame arms as 36 and 37 adjacent thereto, acts like a sling or hanger plate which firmly supports one end of each of such units as 43 and 44 as at 89 and at like points of zones as 5E and so provides for a straight flat surface as measured in a longitudinal direction along the playing surface 75. Additionally each of the wall portions as 74 and 83 adjacent each vertex portion as 86 and the line or zone of junction of the horizontal skin portions 71 and 81 acts as a rib to resist downward vertical stress applied to such line or zone of junction.

Accordingly, the playing surface 75 is not only weatherproof because of the seal of plastic which goes completely around all of the cores and all of the frame elements but also assembly 22 is strong enough to support the weight of adult players thereon while sufficiently dimensionally stable to provide for accurate billiard play thereon. The entire apparatus weighs less than 250 pounds and is sufficiently rigid that there is less than ½ of an inch of vertical deflection at the center of the surface 75 when that surface supports the weight of two adults thereon those adults having a weight in excess of 350 pounds. The apparatus 20 is light enough i.e., weighing less than 250 pounds, so that it may be moved from one location to another after installation, such as movement between a lawn and to a garage, such movement by normal adults, and also from one location on a lawn or driveway to another as weather and seasons change, as well as being readily installed by the customer after purchase and, allowing for transport after manufacture. The trapezoidal sections of units as 41–48 are stronger and lighter than are solid cores of the same depth completely thereacross, having the same thickness for the full width and length of the playing surface 75.

This rigidity provides that balls used on the playing surface 75 do not roll out of place yet do roll and move smoothly over the top of the playing surface when hit by a mallet.

The light weight is quite important because it provides that a user of that apparatus may readily raise the apparatus and make it level as well as having a straight line surface thereacross inasmuch as a skewed surface or a non level surface as well as a non flat surface would reduce the enjoyment of a game of pool as is usually played on such surface. This apparatus may also be used to play miniature golf or used as a putting green. Dimensions of a preferred embodiment are set out in the attached Table I.

The rim support assembly 24 comprises front, rear, right and left side rails 110–113. These side rails are secured to the front, rear, left and right frame elements 31–34 respectively as shown in FIG. 4 for elements 112, 113, 34 and 33.

Figure 2:
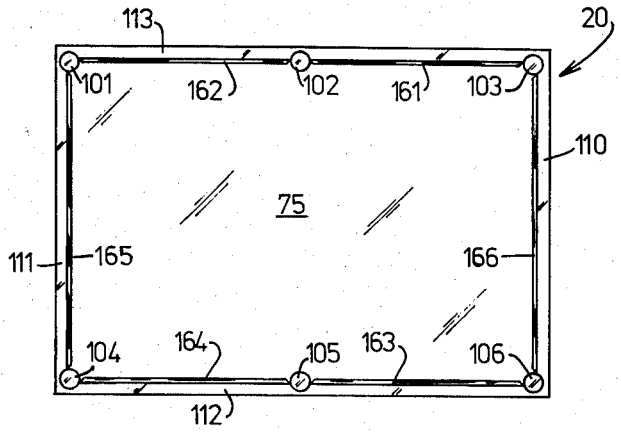
FIG. 2 is a top view of the apparatus 20.

A cushion strip series as 161 and 162 on the left rail 113 and strips 163 and 164 on the right rail and 165 and 166 on the rear and front rails 111 and 110 respectively are attached to such rails in conventional manner adjacent to pockets as 101–106 as shown in FIG. 2. For each of the rails as shown for rails 112 and 113 the outside skirt portion as 119 is connected to the surface 75 across the top of the rail as 113. Accordingly, expansion of the surface 75 horizontally due to temperature changes does not create any high stresses on table or on rails due to such contractions or expansions because of the flexible nature of the tops of skirts 116–119 and the vertical portions of the walls as 181, 182 and 183 immediately below and adjacent to the cushion as 161 and 163 and 186 respectively and adjacent cushion 165 and a like portion, 184, not shown.

TABLE 1

| Dimensions of Apparatus 20 | |
|---|---|
| width, total (skirt 119–118) | 7 feet |
| width, surface 75 (181–182) | 6 feet 5 inches |
| width, bumper (163–161) | 6 feet 2½" |
| length, total (skirt 116–117) | 10 feet |
| length, surface 75 (183–184) | 9 feet 4½" |
| length, bumper (165–166) | 9 feet 2 inches |
| height, skirt 118 | 10 feet |
| Ball Diameter | 3½ feet |
| weight | 1 lb. 2 oz. |
| hole 101–106 diameter | 6 inches |
| foot 135, diameter | 6 inches |
| (molded resin) | |
| Unit 41; height top 68 to | |
| bottom 69 | 3 inches |
| width across 69 | 7 inches |
| width across 68 | 9 inches |
| thickness of skin 70 | 3/16 inches |
| Beam 36, 37 (nominal size) | 1" × 4" |
| 31–34 (nominal size) | 2" × 4" |
| material | pine |
| joining of 31–34, 36, 37 | nails and skin 70 |
| Space between cores of units | |
| as 43 and 42 at vertex as 86 | ¾ inch |
| (this space filled with resin | |
| to depth of at least ½") | |
| Amount of resin used | 16 gal. per table |
| resin weight | 10 lb. per gallon |
| polyester resin (for | |
| fiberglass) | |
| Carpet 75; | |
| thickness fiber layer 78 | ⅛ inch |
| thickness fabric layer 77 | 1/32 inch |
| thickness foam rubber | ⅛ inch |

I claim:

1. A portable billiard game apparatus comprising, in combination, a substantially rectangular playing surface and surface support assembly and a rim and rim support assembly, the surface and surface support assembly comprising a frame assembly, a plurality of adjacently positioned like floor support units, a plurality of like frame support and adjustment assemblies and an upper playing surface, said frame assembly comprising straight rigid side elements and transverse rigid straight frame elements extending between and fixed to said side elements, the floor support units each comprising a core composed of a plurality of vertical rigid floor support columns and a strong skin extending thereover, the cross-section of each floor support unit being trapezoidal in its transverse cross-section, said skin completely enclosing and being tightly and firmly attached to (a) the columns of each of said floor support units and (b) components of the frame assembly to provide a light yet rigid support structure, the skin of adjacent floor support units are firmly joined together at junctions of the adjacent extremities thereof, said playing surface being flat and comprising a lower foam rubber layer, a middle fabric layer and an upper pile layer, all firmly joined together, said foam rubber layer being firmly attached to said skin said playing surface further having ball receiving pockets, each pocket being an opening at each corner and an opening intermediate each longitudinal side of said playing surface, each frame support and adjustment assembly comprises a rigid foot plate and an adjustable support therefor whereby each foot plate may be raised and lowered relative to the frame assembly, said rim and rim support assembly comprising side rails attached to said frame assembly, said side rails extending above, and around the perimeter of said playing surface; cushion means attached to said side rails for rebounding balls rolling on said playing surface.

2. Apparatus as in claim 1 wherein said apparatus weighs between 200 and 250 pounds and is sufficiently rigid such that there is less than $\frac{1}{8}$ of an inch of vertical deflection at the center of the top of the surface layer when that surface layer supports a weight of 350 pounds.

* * * * *